United States Patent [19]

Hoaglan

[11] Patent Number: 5,020,709

[45] Date of Patent: Jun. 4, 1991

[54] CONVERTIBLE CHILD CARRIER

[75] Inventor: Anna M. Hoaglan, Woodland Hills, Calif.

[73] Assignee: International Design/Manufacturing, Inc., Redondo Beach, Calif.

[21] Appl. No.: 466,003

[22] Filed: Jan. 16, 1990

Related U.S. Application Data

[63] Continuation-in-part of Ser. No. 335,868, Apr. 10, 1989, abandoned.

[51] Int. Cl.[5] ..... A47D 13/02

[52] U.S. Cl. ..... 224/151; 224/160; 224/161

[58] Field of Search ..... 224/151, 155, 158, 159, 224/160, 161

[56] References Cited

U.S. PATENT DOCUMENTS

| | | | |
|---|---|---|---|
| 3,097,773 | 7/1963 | Cunningham | 224/161 |
| 3,421,670 | 1/1969 | Hansson | 224/161 |
| 3,713,568 | 1/1973 | Sloan | 224/161 |
| 4,402,440 | 9/1983 | Purtzer et al. | 224/159 |
| 4,747,526 | 5/1988 | Launes | 224/161 X |

FOREIGN PATENT DOCUMENTS

| | | | |
|---|---|---|---|
| 2404414 | 6/1979 | France | 224/160 |

OTHER PUBLICATIONS

Advertisement for Kangourou—1986.

*Primary Examiner*—Renee S. Luebke
*Attorney, Agent, or Firm*—Fulwider, Patton, Lee & Utecht

[57] ABSTRACT

The convertible child carrier, which may be used in a front style, soft carrier mode or in a back style, rigid frame carrier mode, includes an adjustable inner seat for receiving and supporting a child, and an outer seat carrying the adjustable inner seat, including straps for adjusting the position of the inner seat in the outer seat. A frame channel in the outer seat is adapted to receive a rigid frame which may include a folding strand pivotally mounted to the legs of the base portion of the frame, so that the child carrier apparatus may be set up as a free-standing chair.

20 Claims, 3 Drawing Sheets

CONVERTIBLE CHILD CARRIER

RELATED APPLICATIONS

This is a continuation-in-part of Ser. No. 07/335,868 filed on Apr. 10, 1989, and now abandoned.

BACKGROUND OF THE INVENTION

1. Field of the Invention

This invention is directed to a convertible child carrier, and more specifically, the invention concerns a child carrier which is capable of being interchangeably used as a soft, front-style carrier in one mode, and as a frame supported carrier in another mode.

2. Description of Related Art

The basic idea of a soft, front-style child carrier is well known. Current designs are based on the concept of a soft, comfortable fabric seat, with or without holes for the legs of an infant, with shoulder straps affixed to a part of the fabric seat. Such soft, front-style child carriers are generally limited to use for children ranging from new born infants to infants weighing up to about 20 pounds.

Frame supported child carriers are generally only useful for carrying larger children such as toddlers weighing 15 to 40 pounds. Such frame carriers generally include a frame bar which rests on the upper back or shoulders of the wearer, and to which the shoulder straps are attached. This type of carrier is limited to use for carrying more mature children who are self-supportive. Both soft and frame supported carriers thus have limited usefulness.

Child carriers often include a number of straps or other fasteners allowing for some adjustment to fit the size and weight of children to accommodate limited developmental changes, but conventional child carriers of either the soft, front-style or frame supported form are generally not designed to be transformable from one style to another to be useful throughout the growth period of a child, and for use with different ages and weight of children. It would be desirable to provide a convertible child carrier which can be used as a soft, front-style carrier which can be used for carrying an infant from birth, which can later be used as the child develops as a frame supported carrier, and which can be equipped with a stand, to be useful as a chair for the larger child. It is also desirable that a convertible child carrier should provide as much comfort and balance as possible in both modes of use. The present invention fulfills these needs.

SUMMARY OF THE INVENTION

The present invention provides for a convertible child carrier having an adjustable inner seat for receiving and supporting a child, to provide a range of depth of the seat for a growing child. An outer seat supporting the adjustable inner seat also includes a frame channel to receive a rigid frame and to provide extra cushioning. The frame may also include a folding stand pivotally mounted to the legs of a base portion of the frame and adapted to lock in an extended position, so that the child carrier apparatus may be advantageously set up as a free-standing chair.

Briefly and in general terms, a convertible child carrier according to the present invention comprises an adjustable inner seat; an outer seat carrying the inner seat; and a frame channel in the outer seat for receiving at least a portion of a rigid frame member, so that the carrier may be interchangeably used as a soft, front style carrier, or as a frame supported carrier.

In one aspect of the presently preferred embodiment, the outer seat of the convertible child carrier includes an upper portion of fabric which can be placed in an upright position to serve as a windbreaker in the soft carrier mode; and can be folded over to form a frame channel for the frame carrier mode. In another aspect, the convertible child carrier also comprises a rigid frame having a U-shaped upper portion of the frame adapted to be received in the frame channel. The frame may also include a folding stand pivotally mounted to the legs of the base portion of the frame and adapted to lock in an extended position whereby the child carrier apparatus may be configured as a freestanding chair.

Other aspects and advantages of the invention will become apparent from the following detailed description, and the accompanying drawings illustrating by way of example the features of the invention.

DETAILED DESCRIPTION OF THE PREFERRED EMBODIMENT

Figure 1:
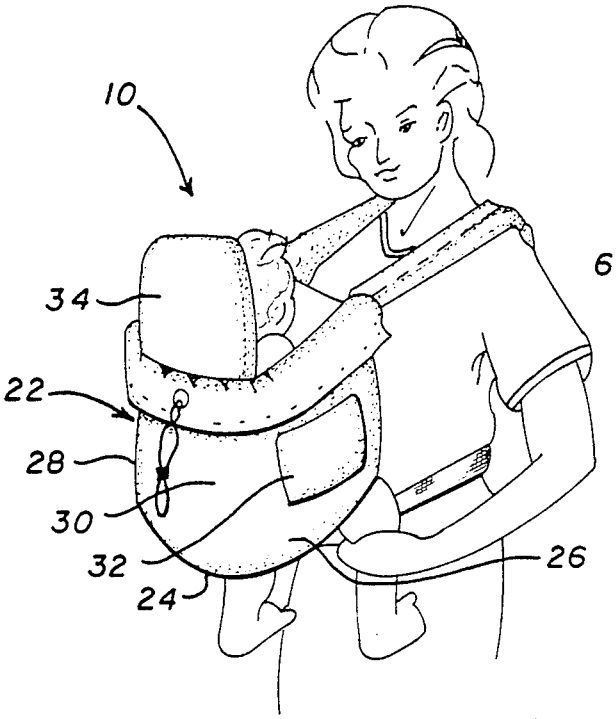
FIG. 1 is a rear perspective view of the convertible child carrier worn in the soft, front-style configuration.

As is shown in the drawings for purposes of illustration, the currently preferred form of the invention is embodied in a convertible child carrier having an adjustable inner seat for receiving and supporting a child in either the soft carrier or frame carrier modes; an outer seat carrying the inner seat; and a frame channel in the outer seat for receiving a portion of a frame in the frame supported mode of the carrier.

The upper portion of the fabric of each of the rear and two side portions of the outer seat may be unfolded and used as a protective extension of the carrier in a soft carrier mode, or may be folded over onto itself to form the frame channel in the frame carrier mode. The child carrier is thus convertible between front style, soft carrier, and frame supported modes.

Figure 3:
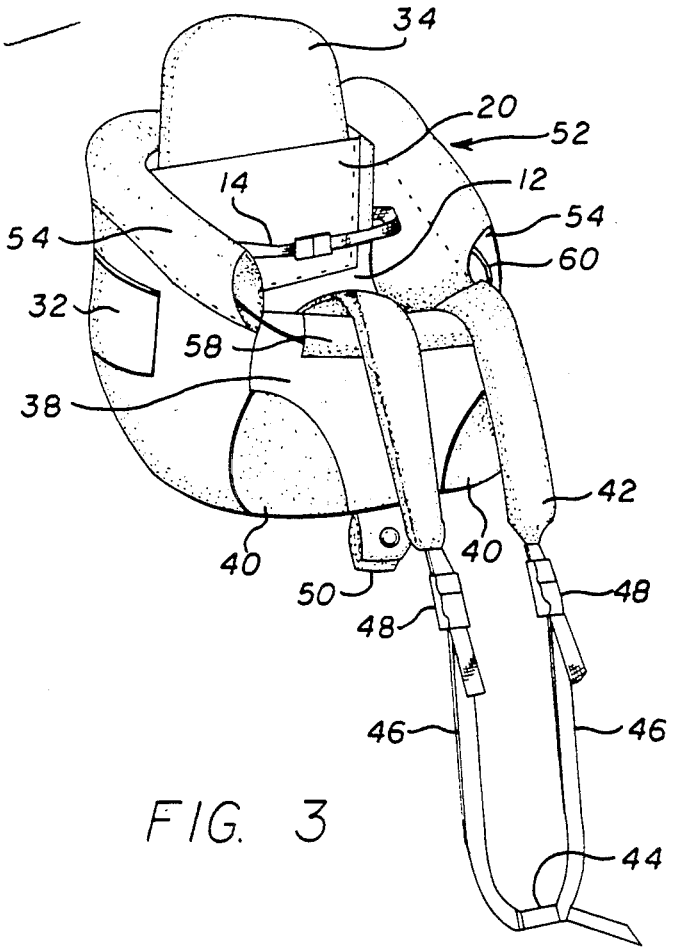
FIG. 3 is a front perspective view of the child carrier of FIG. 1.
Figure 7:
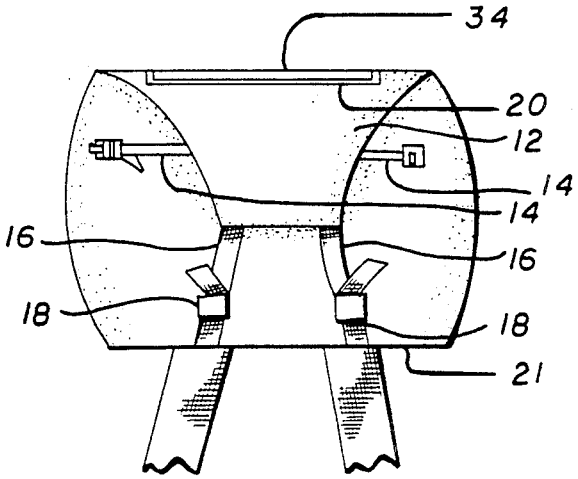
FIG. 7 is a top view of the inner seat and headrest.

With reference to the drawings, the convertible child carrier will be first described in the front style, soft carrier mode. As is shown in FIGS. 1 and 3, the convertible child carrier 10 includes a smaller, inner seat 12, constructed in a "sling" configuration, having an inner safety belt 14 affixed to the sides of the inner seat to accommodate all ages of children, and designed to wrap around the lower waist area of a child seated in the inner seat. The inner seat is preferably secured by adjustable straps 16 having adjustable component buckles 18 to the inside front 21 of an outer seat 22 as shown in FIG. 7, and is securely sewn to the rear inside portion of the outer seat to hang in an adjustable sling like fashion to offer a variety of seat depth positions for a growing infant. When released to its full length, the inner seat matches the depth of the outer seat. The inner seat and the outer seat are preferably made of durable fabric such as nylon, but could also be made from leather or plastic sheet material, or other similar materials. The adjustable straps 16 suspending the inner seat are also preferably made of durable fabric such as nylon, and adjustable in length by the component buckles 18. The inner safety belt is also preferably made of durable fabric such as nylon. Affixed to the back portion of the inner seat is a pocket 20 to receive a removable headrest 34. The removable headrest is used generally in the soft carrier mode to support the newborn infant which cannot support its head sufficiently at this period of growth.

Referring to FIG. 1, the outer seat 22 generally has a bottom portion 24, a right side 26, a left side 28, a rear portion 30, and a front portion 38. For convenience, a pocket 32 may also be placed on a side of the outer seat. The inner seat passes underneath the child and allows room for the legs of the child to extend through leg-holes 40 of the outer seat support.

As is illustrated in FIG. 3, also mounted to the front of the outer seat, preferably sewn in place, are shoulder straps 42 to be placed over the shoulders of a person carrying the convertible child carrier in either the soft front style mode or the frame carrier mode. A first set of detachable extension straps 46 are preferably attached to the ends of the shoulder straps 42, preferably by component buckles 48, and have a length sufficient to wrap around the waist of the wearer in the soft carrier mode. The function of the first set of detachable extension straps is to function as a part of the shoulder straps in the soft carrier mode to lengthen the shoulder straps to a length sufficient to cross in back, and wrap around to the front waist of the wearer in the soft carrier mode.

Figure 8:
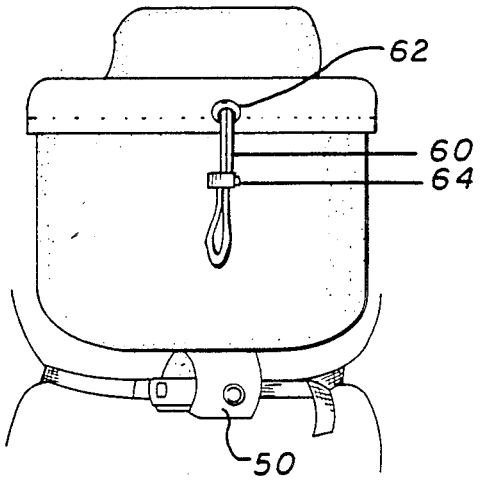
FIG. 8 is a rear view of the child carrier illustrating the seat snap tab.

As is best seen in FIGS. 3 and 8, in the soft front-style form of the child carrier the fastening of the seat snap 50 at the front underside of the outer seat, about the extension straps 46 at the waist of the wearer, serves as a means for engaging the outer seat to the extension straps at the waist of the wearer to prevent free swinging of the child carrier. The snap tab consists of two pieces of fabric, including a heavy duty snap, which when closed around the extension straps, serves to attach the extension straps to the outer seat at a central point. The weight of the infant at this central point holds down the extension straps and prevents the extension straps from "riding up" from the preferred position at the waist. The snap tab could also be constructed as a loop through which the extension straps at the waist of the wearer can simply be threaded, as a means to engage the outer seat to the extension straps at this central point. The snap tab holds the seat close to the body of the wearer to reduce side-to-side sway and outward swing of the carrier. The ends of the extension straps are preferably connectable with a side release buckle 44, or may include a "D" ring buckle to which the extension straps 46 may be tied.

Figure 2:
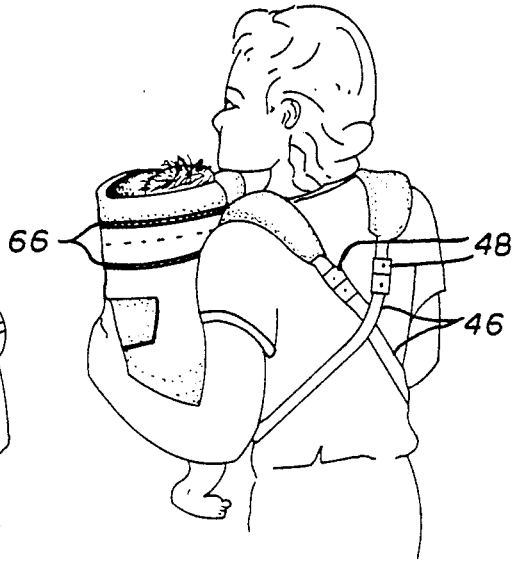
FIG. 2 is a front perspective view of the carrier of FIG. 1 with the frame channel in an open position.
Figure 9:
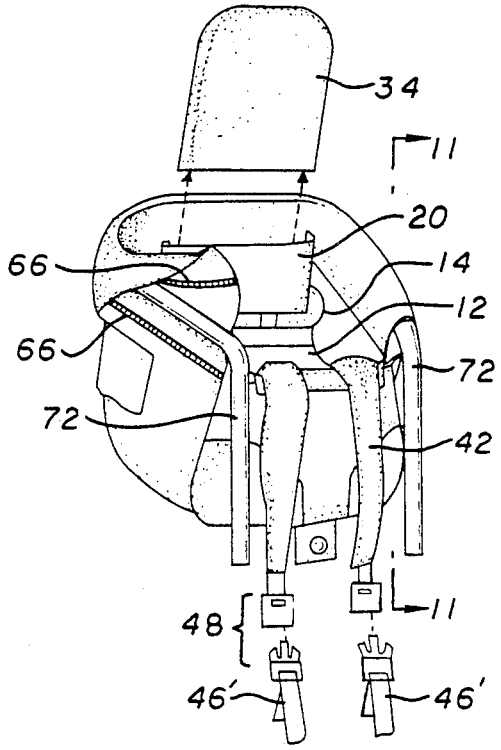
FIG. 9 illustrates attachment of the carrier seat to the upper frame.
Figure 10:
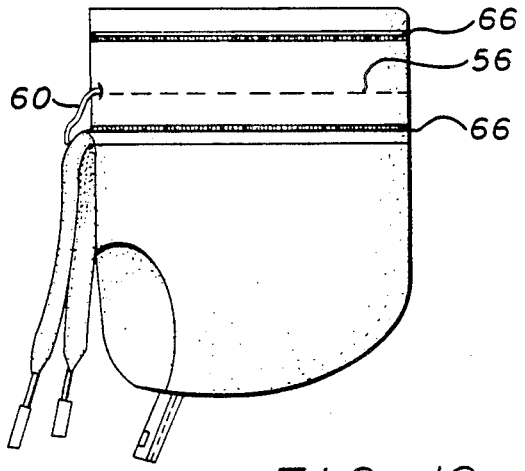
FIG. 10 is a side view of the child carrier showing the zippered frame channel.

The convertible child carrier includes a number of features which provide for the convertibility of the carrier between the soft carrier and frame carrier modes. As is shown in FIGS. 2, 9, and 10, the upper portion 52 of the outer seat may be left unfolded in the soft carrier mode to serve as a wind break, and may be folded over onto itself and zippered closed to form a frame channel 54 for receiving a portion of a frame member in the frame carrier mode. A heavy duty separating zipper 66 is sewn to the upper portion of the outer side of the outer seat with the two components of the zipper being spaced apart, in the preferred embodiment. The space of fabric between the two spaced apart zipper components is sufficient to wrap around the upper frame tube 72. When the two zipper components are zipped together the length of the fabric therebetween therefore forms a closed frame channel 54. The fabric behind the zipper is preferably reinforced with a semi-stiff underlayer 68 that resists being caught in the zipper when the zipper is being closed. Attached between the layers of fabric is a layer of a soft open-cell foam 70 to cushion the frame channel against the frame. The top portion of the outer seat, when not zipped, can be left in an unfolded, upright wind breaker position to form a protective extension against adverse conditions of the weather. A fixed channel of a fold of fabric which is sewn closed could also be used as a frame channel. The upper portion of a frame may then be utilized to form the frame carrier mode of the convertible child carrier by directing the upper frame through the frame channel.

Figure 11:
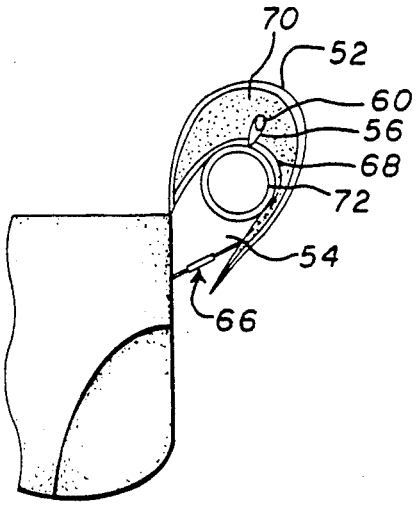
FIG. 11 is a cross-sectional view of the frame channel of the carrier taken along line 11—11 of FIG. 9.

Referring to FIGS. 3, 10 and 11, an inner seat cord channel 56 is also preferably formed in the fabric of the top sides 52 and back 30 of the frame channel portion of the outer seat. A connecting seat cord channel 58 traverses the top front 38 of the seat. A seat cord 60 circuits the inner seat cord channel and the connecting channel, and exits through an opening 62 at the back 30 of the seat. A sliding cordlock device 64 permits reduction of the perimeter of the seat. The purpose of reducing the perimeter of the seat is to bring the seat closer to the wearer's body to lend frontal support to the new born infant in the soft carrier mode, an advantage not possible with a fixed frame perimeter.

One aspect of the convertible child carrier of the invention is the capability of receiving a frame member for converting between the soft, front-style child carrier mode and the frame supported back-style carrier mode. Thus, the child carrier of the invention can be utilized for children ranging from newborn infants to larger, heavier children. As is shown in FIG. 9, a U-shaped upper portion of a frame 72 can be inserted through the frame channel 54 in the upper portion of the outer seat. The frame is preferably made of tubular aluminum, but may also be formed of tubular stainless steel, plastic rod or tubing, or other appropriate materials. The upper frame 72 includes a base portion 74 which may be simply comprised of an extension of the legs 76 of the U-shaped upper frame portion 72.

Figure 4:
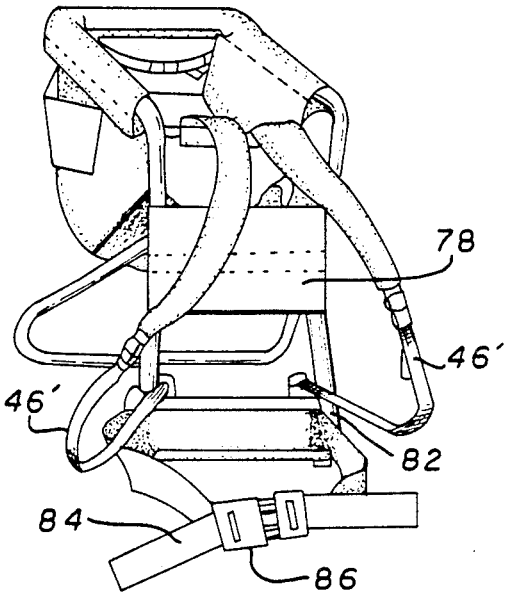
FIG. 4 is a front perspective view of child carrier in the backstyle, frame configuration.
Figure 6:
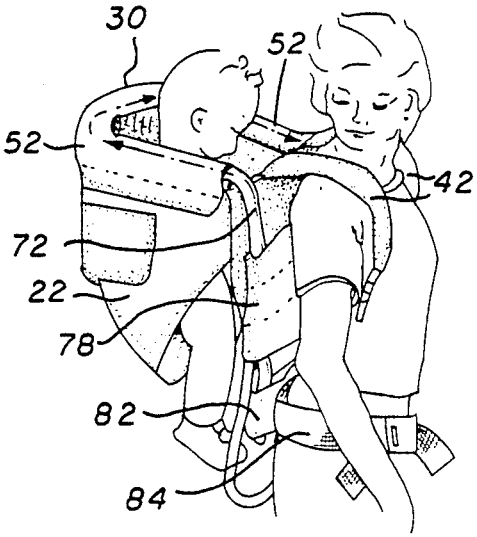
FIG. 6 is a side perspective view of the convertible child carrier in the back-style, frame configuration, illustrating the function of the backpad and upper frame.

Referring to FIGS. 4 and 6, an upper fabric backpad 78 including an inner foam layer is preferably secured between the frame legs 76 in a position so as to rest against the upper or middle back of a person carrying the child carrier in the frame style mode of the child carrier. In one current embodiment of the backpad, the backpad material wraps around the legs of the frame, and attaches around the legs by straps and Velcro fasteners (not shown) located on the backpad material. The upper backpad may include a storage compartment as well. The backpad cushions the wearer's back from pressure from the frame.

A lower connecting bow 82 also preferably extends across the lower legs of the frame in a similar manner to secure the lower legs of the frame together, and to rest against the lumbar area of the person carrying the child carrier in the frame carrier mode. The connecting bow 82 is preferably secured to the shoulder straps 42 with a second set of detachable extension straps 46' and matching component buckles 48 which are interchangeable with the first set of extension straps and matching component buckles, in the frame carrier mode. A waist belt assembly 84 is preferably sewn to the lower connecting bow 82 of the lower frame, and preferably includes a side release buckle 86 for quick connection and quick release of the child carrier. The waist belt 84 serves to secure the weight of the child at a height that transfers a large portion of the weight from the shoulders to the hips. The waist belt also helps to prevent any free swinging motion of the carrier.

Figure 5:
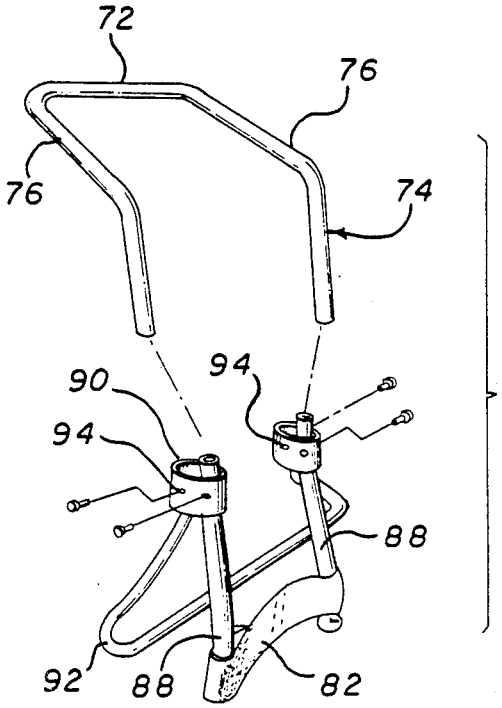
FIG. 5 is an exploded view of the frame showing assembly of the folding stand.

As is shown in FIG. 5, the frame also includes a lower portion comprised of lower legs 88 which may be either an extension of the legs 76 of the upper frame, or may be joined as separate pieces, as in the currently preferred embodiment. The frame most preferably includes brackets 90 on the legs 88 of the lower portion of the frame, to which a U-shaped stand member 92 is pivotally mounted at the pivot points 94. The brackets are shaped so as to allow limited swivelling motion of the pivotable stand member 92, so that the stand can be locked in an open position. This allows the frame supported child carrier to be placed in a free standing position to serve as a chair. Alternatively, the pivotable stand may comprise separate lengths of aluminum tubing to form legs which can be moved into position individually to form the free standing configuration of the child carrier.

From the foregoing, it will be appreciated that the present invention offers a convertible child carrier which can be interchangeably used as a soft, front-style carrier, and as a frame supported carrier which can also be set up as a chair.

It is significant that the frame channel formed in the upper portion of the outer seat may be left in an open position to provide additional protection and includes an inner seat cord channel for adjustment of the perimeter of the soft-style carrier, while it also allows the carrier to be simply converted into a frame supported carrier by insertion of a frame through the frame channel. It is significant that the shoulder straps are attached to the outer seat in both modes, and that one set of detachable extension straps are connected to the shoulder straps in the soft carrier mode to serve as a waist strap and as a means for securing the outer seat via a seat snap, and that a second interchangeable set of extension straps are connected to the lower frame and shoulder straps in the frame carrier mode. It is also significant that the inner seat is adjustable to the full depth of the outer seat support, to provide a range of depth of the seat for a growing child.

This invention having been described in its preferred and alternative embodiments, it is clear that it is susceptible to numerous modifications and embodiments within the ability of those skilled in the art and without the exercise of the inventive faculty. Thus, it should be understood that various changes in form, detail and application of the present invention may be made without departing from the spirit and scope of this invention.

I claim:

1. A convertible child carrier apparatus capable of being used by a wearer in either a front style, soft carrier mode, or a back style, frame carrier mode, comprising:

a) an outer seat member having upper and lower portions, including a pair of shoulder straps attached to said upper portion adapted to engage a wearer's shoulders, and said outer seat member including means for connecting said shoulder straps to said lower portion of said outer seat in said front style, soft carrier mode;

b) an inner seat member for receiving and supporting a child, said inner seat member having a first side fixedly mounted to an inside portion of said outer seat member and a second side adjustably mounted to an opposite inside portion of said outer seat member; and c) a frame channel in said outer seat member including means for opening and closing said frame channel for removably receiving at least a portion of a rigid frame member; whereby said convertible child carrier apparatus may be used in said front style, soft carrier mode without a frame, and in said back style, rigid frame carrier mode when a frame is received in said frame channel.

2. The convertible child carrier apparatus of claim 1, wherein said inner seat member is adapted to receive a headrest support.

3. The convertible child carrier apparatus of claim 1, wherein said inner seat member includes a pocket for receiving a removable headrest support.

4. The convertible child carrier apparatus of claim 1, wherein said outer seat member has an outer perimeter and said frame channel includes an inner seat cord channel and a seat cord for reducing the perimeter of said outer seat member.

5. The convertible child carrier apparatus of claim 1, wherein said means for opening and closing said frame channel includes a separating zipper.

6. The convertible child carrier of claim 1, wherein said shoulder straps include a detachable pair of extension straps adapted to be connected about a wearer's waist.

7. The convertible child carrier apparatus of claim 1, further including a rigid frame member having a U-shaped upper frame portion adapted to be received in said frame channel in said outer seat member.

8. The convertible child carrier apparatus of claim 7, wherein said frame member includes a base portion having a waist strap.

9. The convertible child carrier apparatus of claim 7, wherein said frame member includes a pair of legs extending from said U-shaped upper frame portion and a back pad portion extending between the legs.

10. The convertible child carrier apparatus of claim 7, wherein said U-shaped upper portion of said frame member comprises two leg portions and a cross bar portion connecting said two leg portions, and said frame channel is adapted to receive said upper portion of said frame member such that said cross bar portion is positioned away from the wearer's shoulders when said carrier is used in said frame carrier mode.

11. The convertible child carrier apparatus of claim 7, wherein said frame member includes a base portion having a pair of legs extending from said U-shaped upper frame portion and a connecting bow securing said legs together, and said shoulder straps include a detachable pair of extension straps attached to said connecting bow for securing said connecting bow to said outer seat member.

12. The convertible child carrier apparatus of claim 1, wherein said frame channel comprises a fabric upper portion of said outer seat member which is adapted to be releasably secured in a folded position to form a channel for receiving said portion of said frame member in said frame carrier mode, and which is adapted to be unfolded to form a protective extension of said outer seat member in said soft carrier mode.

13. A convertible child carrier apparatus comprising:

a) an outer seat having front, rear, bottom and top portions, and a pair of shoulder straps connected to a front top portion of said outer seat;

b) an inner seat disposed within said outer seat for receiving and supporting a child, said inner seat having a rear side fixedly mounted to a rear inside portion of said outer seat, and a front side mounted to a front inside portion of said outer seat by a pair of adjustable straps;

c) means for connecting said shoulder straps together and for connecting said shoulder straps to a bottom front portion of said outer seat for use in a front style, soft carrier mode; and d) a frame channel in said top portion of said outer seat including means for opening and closing said frame channel to removably receive a rigid frame member for supporting said outer seat; whereby said rigid frame member may be inserted in said frame channel so that said apparatus may be used as a back style rigid frame carrier, and said rigid frame member may be removed from said frame channel for use of said apparatus in said front style, soft carrier mode.

14. A convertible child carrier apparatus, comprising:

a) an outer seat having upper and lower portions, and including a pair of shoulder straps attached to said upper portion adapted to engage a wearer's shoulders;

b) an inner seat for receiving and supporting a child, said inner seat having a first side fixedly mounted to an inside portion of said outer seat and including a pocket for receiving a removable headrest support, and having a second side adjustably mounted to an opposite inside portion of said outer seat; and c) a frame channel in said upper portion of said outer seat adapted to receive at least a portion of a rigid frame member, whereby said convertible child carrier apparatus may be used in the front style, soft carrier mode without the frame member, and in a back style rigid frame carrier mode when the frame member is received in said frame channel.

15. A convertible child carrier apparatus, comprising:

a) an outer seat having upper and lower portions, and including a pair of shoulder straps attached to said upper portion of said outer seat adapted to engage a wearer's shoulders;

b) an inner seat for receiving and supporting a child, said inner seat having a first side fixedly mounted to an inner portion of said outer seat and a second side adjustably mounted to an opposite inside portion of said outer seat; and c) a frame channel in said upper portion of said outer seat and having an outer perimeter, said frame channel being adapted to receive at least a portion of a rigid frame member, said frame channel including an inner seat cord channel and a seat cord extending through said inner seat cord channel for reducing the perimeter of said frame channel in said outer seat, whereby said convertible child carrier apparatus may be used in a front style, soft carrier mode without the frame member, and in a back style, rigid frame carrier mode when the frame member is received in said frame channel.

16. A convertible child carrier apparatus, comprising:

a) an outer seat having upper and lower portions, and including a pair of shoulder straps attached to said upper portion adapted to engage a wearer's shoulders;

b) an inner seat for receiving and supporting a child, said inner seat having a first side fixedly mounted to an inside portion of said outer seat and a second side adjustably mounted to an opposite inside portion of said outer seat; and c) a frame channel in said upper portion of said outer seat including a separating zipper for opening and closing said frame channel, for removably receiving at least a portion of a rigid frame member, whereby said convertible child carrier apparatus may be used in a front style, soft carrier mode without the frame member, and in a back style, rigid frame carrier mode when the frame member is received in said frame channel.

17. A convertible child carrier apparatus, comprising:

a) an outer seat having upper and lower portions, and including a pair of shoulder straps attached to said upper portion of said outer seat adapted to engage a wearer's shoulders, said outer seat including means on said lower portion of said outer seat for securing said shoulder straps to said lower portion of said outer seat, and said shoulder straps including a detachable pair of extension straps adapted to be connected about a wearer's waist;

b) an inner seat for receiving and supporting a child, said inner seat having a first side fixedly mounted to an inside portion of said outer seat and a second side adjustably mounted to an opposite inside portion of said outer seat; and c) a frame channel in said upper portion of said outer seat adapted to receive at least a portion of a rigid frame member, whereby said convertible child carrier apparatus may be used in a front style, soft carrier mode without the frame member, and in a back style, rigid frame carrier mode when the frame member is received in said frame channel.

18. A convertible child carrier apparatus, comprising:

a) an outer seat including a pair of shoulder straps attached to said outer seat adapted to engage a wearer's shoulders;

b) an inner seat for receiving and supporting a child, said inner seat having a first side fixedly mounted to an inside portion of said outer seat and a second side adjustably mounted to an opposite inside portion of said outer seat;

c) a frame channel in said outer seat adapted to receive at least a portion of a rigid frame member; and d) a rigid frame member having a U-shaped upper frame portion adapted to be received in said frame channel, said U-shaped upper portion of said frame member comprising two leg portions and a crossbar portion connecting said two leg portions, and said frame channel being adapted to receive said upper portion of said frame member such that said crossbar portion is positioned away from the wearer's shoulders when said carrier is used in a back style frame carrier mode.

19. A convertible child carrier apparatus, comprising:

a) an outer seat including a pair of shoulder straps attached thereto, adapted to engage a wearer's shoulders;

b) an inner seat for receiving and supporting a child, said inner seat having a first side fixedly mounted to an inside portion of said outer seat and a second side adjustably mounted to an opposite inside portion of said outer seat;

c) a frame channel in said outer seat; and d) a rigid frame member having a U-shaped upper frame portion adapted to be received in said frame channel and a base portion having a pair of legs extending from said U-shaped upper frame portion and a connecting bow securing said legs together, said shoulder straps including a detachable pair of extension straps attached to said connecting bow for securing said connecting bow to said outer seat.

20. A convertible child carrier apparatus comprising:

a) an outer seat including a pair of shoulder straps attached thereto adapted to engage a wearer's shoulders;

b) an inner seat for receiving and supporting a child, said inner seat having a first side fixedly mounted to an inside portion of said outer seat and a second side adjustably mounted to an opposite inside portion of said outer seat; and c) a frame channel in said outer seat comprising a fabric upper portion of said outer seat which is adapted to be releasably secured in a folded position to form a channel for receiving a portion of a rigid frame member in a frame carrier mode, and which is adapted to be unfolded to form a protective extension of said outer seat in a soft carrier mode.

* * * * *

UNITED STATES PATENT AND TRADEMARK OFFICE

CERTIFICATE OF CORRECTION

PATENT NO. : 5,020,709

DATED : June 4, 1991

INVENTOR(S) : Anna M. Hoaglan

It is certified that error appears in the above—identified patent and that said Letters Patent is hereby corrected as shown below:

On the Title page

In the Abstract, line 8, delete "strand" and insert therefor

--stand--;

Column 1, line 42, delete "weight" and insert therefor

--weights--;

Column 2, line 8, delete ";" and insert therefor

--,--.

Signed and Sealed this

Twenty-ninth Day of December, 1992

*Attest:*

DOUGLAS B. COMER

*Attesting Officer*

*Acting Commissioner of Patents and Trademarks*